US005771299A

United States Patent [19]

Melanson

[11] Patent Number: 5,771,299

[45] Date of Patent: Jun. 23, 1998

[54] SPECTRAL TRANSPOSITION OF A DIGITAL AUDIO SIGNAL

[75] Inventor: John Laurence Melanson, Boulder, Colo.

[73] Assignee: AudioLogic, Inc., Boulder, Colo.

[21] Appl. No.: 667,149

[22] Filed: Jun. 20, 1996

[51] Int. Cl.[6] ..... H04R 25/00

[52] U.S. Cl. ..... 381/68.2; 381/68; 381/68.4

[58] Field of Search ..... 381/60, 68, 68.2, 381/68.4; 395/2.26, 2.18, 2.28, 2.33; 364/724.19, 724.2, 724.17, 724.15

[56] References Cited

U.S. PATENT DOCUMENTS 4,051,331 9/1977 Strong et al. ..... 381/68.4
5,488,704 1/1996 Fujimoto ..... 395/2.28

*Primary Examiner*—Huyen Le

*Attorney, Agent, or Firm*—Homer L. Knearl; Holland & Hart 11p

[57] ABSTRACT

In this spectral transposition system for digital audio signals, the coefficients in an analysis filter are passed directly to the synthesis filter so that the coefficients in both filters match. The single unit delays in either or both of the analysis and synthesis filters are replaced by all-pass filters that provide a non-integer delay or an integer delay where the integer is greater than one. Thereby the transfer function for the analysis filter and/or synthesis filter is compressed/expanded depending on the transfer function of the all-pass filters. Thus, the dominant peaks or formants in the frequency spectrum of the resynthesized audio signal is transported to a user determined frequency range. The delay may be constant or variable over frequency. If the delay is variable over frequency so that it is other than 1.0 in the portion of the spectrum of interest for transposition of the spectral envelope and returns to 1.0 at the ends of the spectrum, the spectral envelope may be compressed or expanded without replication.

15 Claims, 6 Drawing Sheets

| | $f(h(z^{-1}))$ | $f(j(z^{-1}))$ |
|---|---|---|
| FIG.1 | $z^{-1}$ | $\frac{\alpha+z^{-1}}{1+\alpha z^{-1}}$ |
| FIG.3A | $\frac{\alpha_1+z^{-1}}{1+\alpha_1 z^{-1}}$ | $\frac{\alpha_2+z^{-1}}{1+\alpha_2 z^{-1}}$ |
| FIG.3B | $\frac{\alpha+z^{-1}}{1+\alpha z^{-1}}$ | $z^{-1}$ |
| FIG.3C | $z^{-1}$ | $z^{-1}.x$ |

FIG. 3E

SPECTRAL TRANSPOSITION OF A DIGITAL AUDIO SIGNAL

BACKGROUND OF THE INVENTION

1. Field of the Invention

This invention relates to a hearing aid which by means of digital signal processing transposes formants of its input signal (e.g. speech) to a frequency range more perceptible for a hearing impaired user.

2. Description of Related Art

Spectral transposition is understood as the process of moving the information content of a signal, for example speech, from its original frequency range to another frequency range. This is not the same as the transposition implied in traditional modulation, but rather a shifting of the envelope of the frequency spectrum of the audio signal.

The primary reference text in speech signal processing is *Digital Processing of Speech Signals* by L. R. Rabiner and R. W. Schafer (Printice-Hall, Inc., 1978). Chapter 8 of this text describes a method for performing spectral transposition. This method involves analysis and resynthesis of a signal, and between analysis and resynthesis the coefficients from the analysis are transformed. The purpose of the transformation is to shift the frequency range of the formants in the speech signal when it is resynthesized.

Another teaching of spectral transposition of the envelope (formants) of the speech signal spectrum, where the coefficients from the adaptive analysis filter are transformed and used in the synthesis filter is discussed in two articles by K. Fink, U. Hartmann and K. Hermansen: "Parametric Based Transformation of Speech Signals" (Proceedings of GRETSI'93, Juan-lesPins, France 1993) and "Feature Extraction for Profoundly Deff People" (Proceedings of EUROSPEECH'93, BERLIN, September 1993). In the Fink et al method, every 1–5 ms. a Linear Predictive Coding (LPC) analysis is performed on a segment (typically 20–30 ms.) of the input signal X(z). This analysis results in a model filter A(z) (typical order 12–20), and a so-called residual signal E(z) from modeling the input signal:

$$(1/A(z))\cdot E(z)=X(z).$$

The model A(z) is then decomposed into a set of second order sections, each modeling a formant peak in the speech spectrum. The decomposition is performed by calculating the spectrum corresponding to the transfer function 1/A(z), and detecting the maxima. Each of these second order sections is then transformed into parameter triplets—center frequency, bandwidth and power—reflecting the complex conjugated pole position and the gain in each filter section.

The parameter triplets are subjected to predetermined transformations. This is where the actual spectral transposition is taking place. Furthermore spectral sharpening can be performed by reducing the bandwidth for each section.

The transformed triplets are composed into a transformed model A' (z), and this model is used with the residual signal E(z) as input to re-synthesize the transformed speech signal:

$$X'(z)=(1/A'(z))\cdot E(z)$$

There are a number of problems associated with this approach to spectral transposition. The most severe is the computational complexity of which the decomposition into second order sections and parameter triplets accounts for approximately half. The other half of the computational complexity is divided between signal analysis and signal re-synthesis. Also, two other problems arise in this approach, namely the delay/latency implied in accurate LPC signal analysis, and the reverberant result of block-based signal processing.

SUMMARY OF THE INVENTION

In accordance with this invention, the above problems have been solved by performing spectral transposition without decomposing and transforming the coefficients between the adaptive digital analysis filter and the digital synthesis filter. In this invention the coefficients in the analysis filter are passed directly to the synthesis filter so that the coefficients in both filters match. The single unit delays in either or both of the analysis and synthesis filters are replaced by all-pass filters that provide a variable delay, where the delay can be a non-integer value usually in the range 0.5 to 2.5. Thereby the transfer function for the analysis filter and/or synthesis filter is compressed or expanded depending on the transfer function of the all-pass filters. Thus, the dominant peaks or formants in the frequency spectrum of the resynthesized audio signal is transported to a user determined frequency range.

Unit delay refers to a delay of one sample period at whatever sample rate is being used. When the non-integer variable delay is greater than one, the spectral envelope is compressed. When the delay is less than one the spectral envelope is expanded.

The delay of the all-pass filter may be variable over frequency. If it is a constant over frequency and greater than one, then there will be a replication of the spectral envelope as well as transposition of the spectral envelope. The undesireable replication may be removed by a low pass filter (or high pass filter depending on the application). If the delay is variable over frequency so that it is other than 1.0 in the portion of the spectrum of interest for transposition of the envelope and returns to 1.0 at the ends of the spectrum of the input signal, the spectral envelope may be compressed or expanded without replication.

As another feature of the invention, the delay might be multiple units of delay, i.e. delay equal to an integer greater than one. Such a configuration produces replications of the spectrum. Replication occurs where change in delay is a pure delay. The replication(s) may be removed with filters.

The foregoing and other features, utilities and advantages of the invention will be apparent from the following more particular description of a preferred embodiment of the invention as illustrated in the accompany drawings.

BRIEF DESCRIPTION OF DRAWINGS

FIG. 3E is a table indicating preferred transfer functions for all-pass filters in various embodiments of the invention as indicated by the figure numbers in the left column.

DETAILED DESCRIPTION OF PREFERRED EMBODIMENTS

Figure 1:
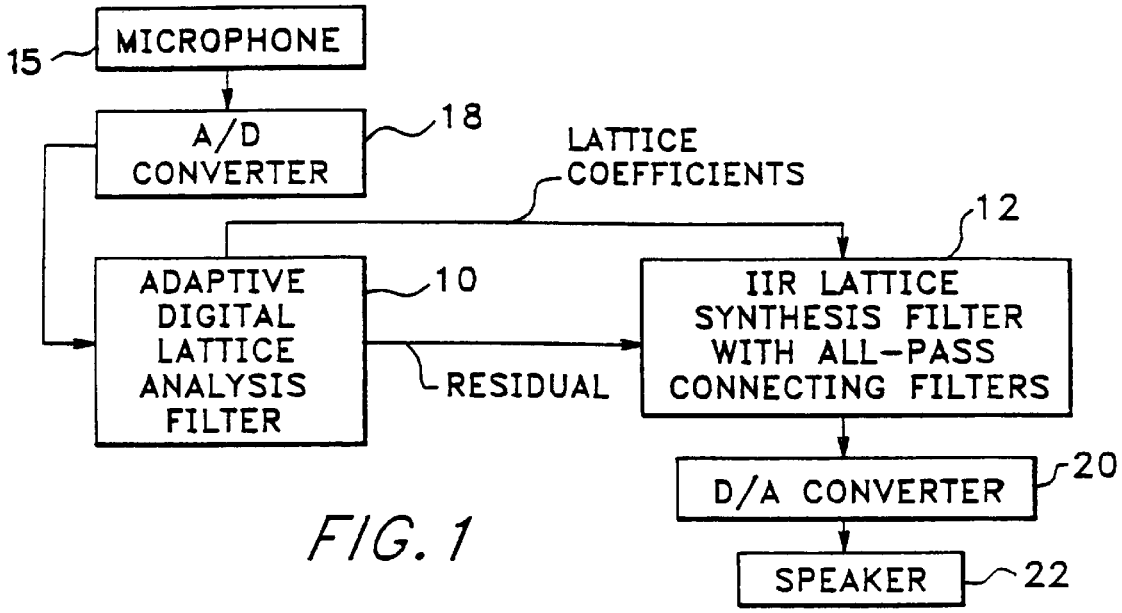
FIG. 1 shows a preferred embodiment of the invention in an audio system with an adaptive, lattice analysis filter and a lattice synthesis filter having coefficients matched to the analysis filter.
Figure 6:
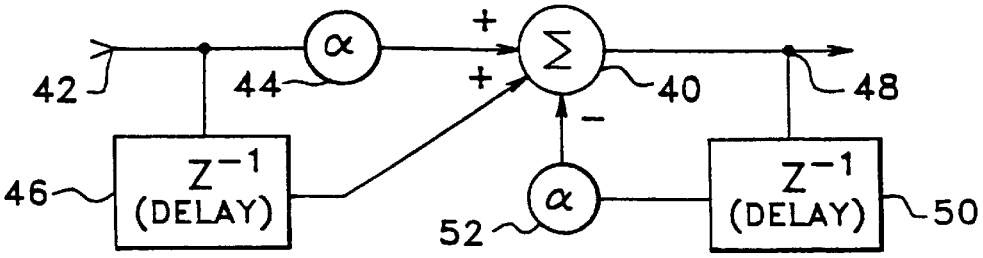
FIG. 6 shows the details of a preferred embodiment for the all-pass filter.

In one preferred embodiment of the invention as shown in FIG. 1, the transposition of the envelope of the frequency spectrum of an audio speech signal is accomplished with an adaptive, digital, lattice, analysis filter 10 and an all-pole lattice synthesis filter 12. Further, the synthesis filter substitutes an all-pass filter in place of each single unit delay element in each lattice stage. The transfer function of the all-pass filter will be discussed shortly hereinafter in the preferred embodiment of the all-pass filter as shown in FIG. 6.

With this configuration, the lattice coefficients determined by the adaptive, digital, analysis lattice filter 10 may be directly passed forward to the lattice synthesis filter. In other words, both the adaptive analysis filter 10 and the synthesis filter 12 will use the same lattice coefficients. The spectral transposition is accomplished by warping the transfer function of the synthesis filter with the all-pass filters.

Figure 2:
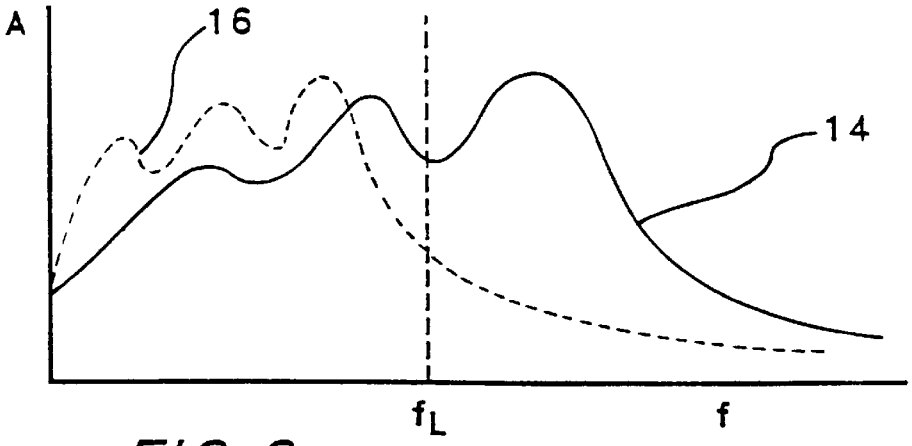
FIG. 2 shows the spectrum of an original audio signal and the transposed spectral envelope of the resynthesized original audio signal.

To understand the operation of FIG. 1, assume that an audio speech input having a spectrum 14 in FIG. 2 has been detected by microphone 15 in FIG. 1. The analog to digital converter 18 converts the analog audio speech signal from microphone 15 to a digital signal.

In FIG. 2 the peaks or humps in the frequency spectrum 14 are the formants of the speech signal. These formants contain the meaningful information or cues for a person listening to the sound. If that person has a hearing loss that cuts off frequencies above $f_L$, then much of the information in the formants of the frequency spectrum 14 are lost to that hearing impaired person.

By warping the envelope of spectrum 14 to the envelope of spectrum 16, the formants are located below frequency $f_L$. To accomplish this transposition or shifting of the frequency spectrum from spectrum 14 to spectrum 16 in FIG. 2, analysis filter 10 is a conventional adaptive digital lattice filter and produces two output signals. One output signal is the lattice coefficients and the other output signal is a residual whitened signal. The whitened signal is a conversion of the input audio speech signal to a frequency spectrum signal where all spectral frequencies have approximately the same amplitude. The lattice coefficients contain the information as to the formants in the frequency spectrum 14. These coefficients are passed to and applied as the same coefficients in the synthesis lattice filter 12. If nothing further was done, the synthesis filter 12 would recover the original signal.

Of course, the objective is not only to recover the original signal, but to transpose its spectrum to a lower frequency range, i.e. frequency spectrum 16 in FIG. 2. By substituting the all-pass filters for the delay element in each of the lattice stages of the synthesis filter 12 to introduce non-integer delays, the spectral envelope of the re-synthesized original signal is shifted to a lower frequency range to produce the frequency spectrum 16 in FIG. 2.

The re-synthesized signal is then passed from synthesis filter 12 to digital-to-analog converter 20. D/A converter 20 generates the analog audio signal. The analog audio signal is passed to the amplifier and speaker 22 to reproduce the sound picked up by microphone 15, but shifted in frequency to a lower frequency range as depicted by the frequency spectrum 16 in FIG. 2.

As mentioned earlier, the adaptive digital lattice filter is a well-known structure and has been used for the analysis of speech. Two articles describing such a filter are "Adaptive Lattice Analysis of Speech" by J. I. Makhoul in IEEE Transactions on Acoustics, Speech, and Signal Processing, Vol. ASSP-29, No. 3, June, 1981, and "Convergence Properties of an Adaptive Digital Lattice Filter" by M. L. Honig and D. G. Mesherschmidt, IEEE Transactions on Acoustics, Speech, and Signal Processing, Vol. ASSP-29, No. 3, June 1981.

Other preferred embodiments of the invention are illustrated in FIGS. 3A–3D. When applied to the hearing aid environment, the analysis and synthesis filters in FIGS. 3A–3D would replace the analysis and synthesis filters in the embodiment of FIG. 1.

Figure 3A:
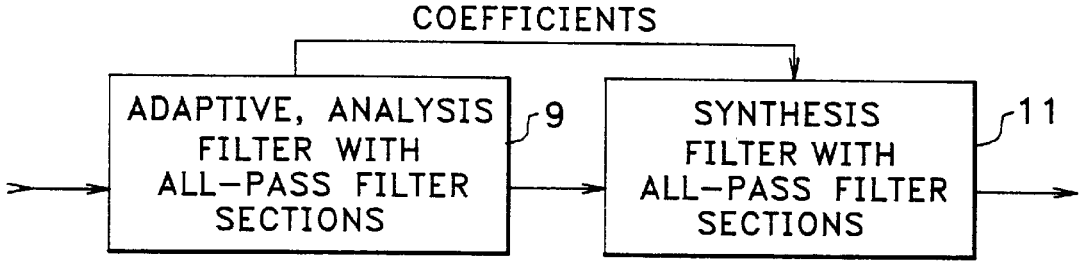
FIG. 3A shows another preferred embodiment of the invention where both the analysis filter and the synthesis filters have all-pass filters to warp the spectral envelope.

In the embodiment in FIG. 3A, both the analysis filter 9 and the synthesis filter 11 have all-pass filters in each section of the analysis and synthesis filters. In other words, an all-pass filter is substituted for the sample unit delay devices in both the adaptive analysis filter 9 and the synthesis filter 11. The coefficients determined by the adaptive analysis filter are passed forward to the synthesis filter and used for the sections of the synthesis filter. There is no requirement to transform the coefficients as has been done in the past to shift the spectrum of the speech signal.

Figure 7:
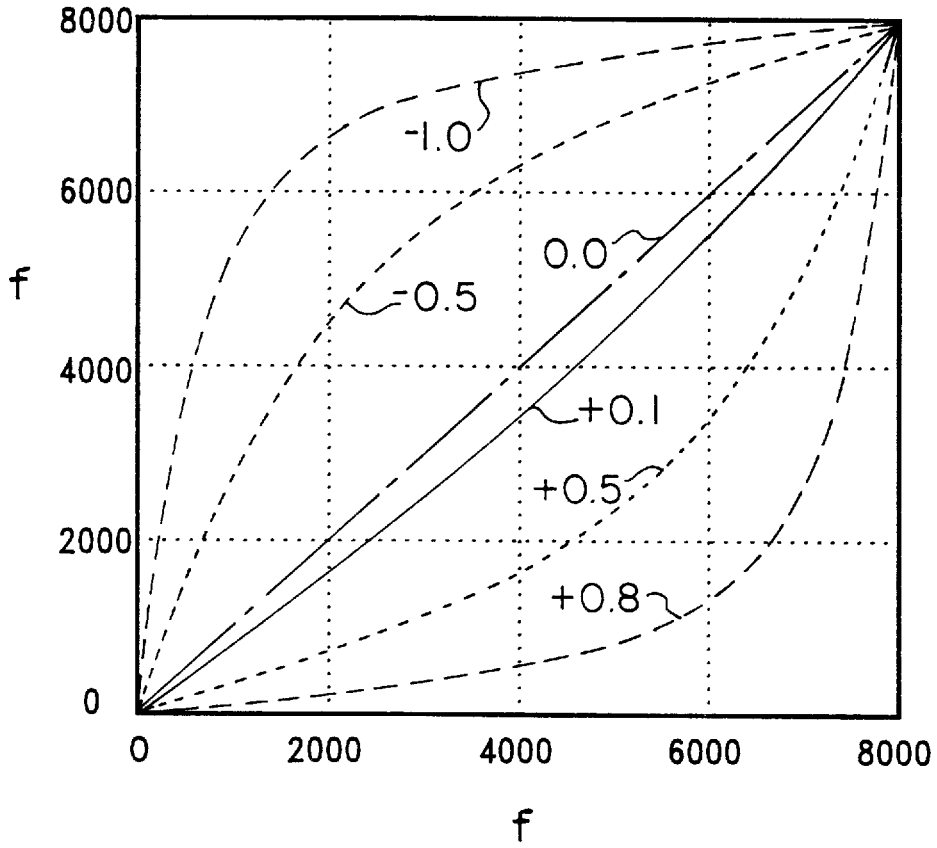
FIG. 7 shows the spectral transposition warp produced by the all-pass filter in FIG. 6 for various alpha values.

The all-pass filters in the adaptive analysis filter must have a different group delay characteristic than the all-pass filters in the synthesis filter. The group delay characteristic is the warp characteristic such as is shown in FIG. 7 for all-pass filter in FIG. 6. If the group delay characteristics of the all-pass filters were the same in both the analysis and synthesis filters, there would be no spectral shift of the formants in the audio speech signal. All-pass filters in the analysis filter 9 (FIG. 3A) have a transfer function designed to warp the lowest frequencies of the speech signals to a slightly higher frequency range. The all-pass filter sections in the synthesis filter 11 would have a transfer function designed to warp the formants at the highest frequencies to a lower frequency range.

Figure 3B:
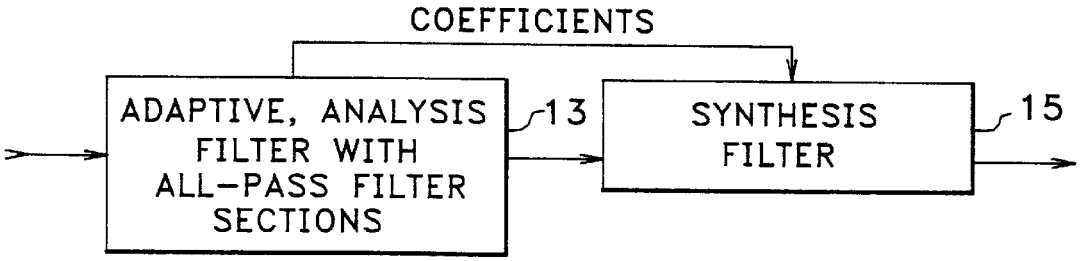
FIG. 3B shows another preferred embodiment of the invention where the analysis filter has all-pass filters to warp the spectral envelope.

In FIG. 3B another alternative preferred embodiment is shown where only the analysis filter has all-pass filter sections. In the embodiment of FIG. 3B adaptive analysis filter 13 has all-pass filters in place of single unit delay elements. Coefficients determined by the adaptive analysis filter are again forwarded directly to the synthesis filter 15. There is no alteration of the coefficients between the analysis filter and the synthesis filter. By using all-pass filter sections in the analysis filter 13, the spectrum of the formants may be transposed upwards or downwards in frequency range depending upon the transfer function of the all-pass filter. The transfer function of the all-pass filter will be discussed shortly hereinafter in a preferred embodiment of the all-pass filter as shown in FIG. 6.

Figure 3C:
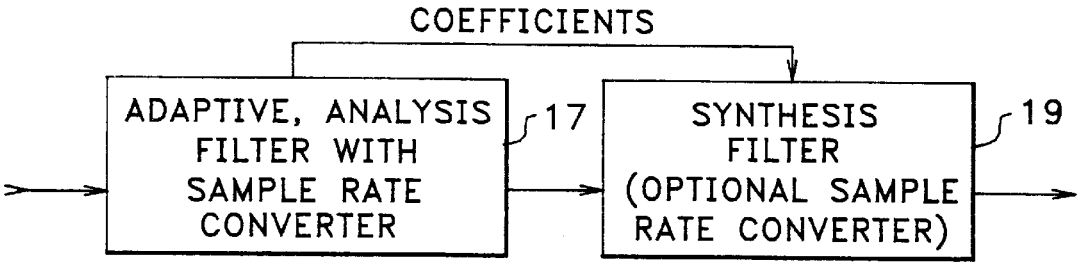
FIG. 3C shows another preferred embodiment of the invention where the analysis filter has a sample rate converter operating for the purpose of producing a fractional unit delay to warp the spectral envelope.

In another preferred embodiment shown in FIG. 3C the adaptive analysis filter 17 at it's output includes a sample rate converter. Now unit delay elements are used in both the analysis filter and the synthesis filter. However, because the sample rate converter at the output of the analysis filter, the effective transfer function of the synthesis filter is a function of z raised to a fractional power between −1 and −2. For example, if the single unit delays are used in the adaptive analysis filter, i.e. function of $z^{-1}$, and the synthesis filter contains normal unit delays which would also normally have a transfer function of $z^{-1}$, then, because of the sample rate converter at the output of the adaptive analysis filter, the effective transfer function of the synthesis filter is a function of $z^{-1.xxx}$ where xxx is greater than 000 and less than 999.

Notice again in the embodiment in FIG. 3C, that the coefficients determined by the adaptive analysis filter are simply passed forward. Thus, the coefficients in the adaptive analysis filter and the synthesis filter are matched. By having a transfer function for the synthesis filter with a fractional power of z, the synthesis filter will shift the spectrum of the formants to a lower frequency range. A second sample reconverter is optional and can be provided at the output of the synthesis filter 19 to bring the sampling frequency of the output signal back up to the same sampling frequency as the input signal to the analysis filter.

Figure 3D:
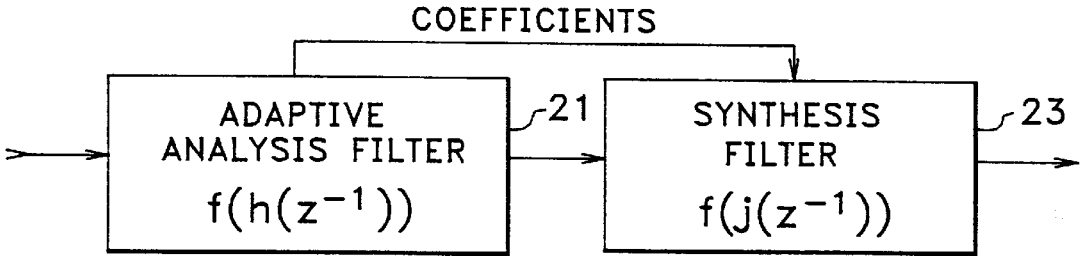
FIG. 3D shows the generic preferred embodiment of the invention indicating that the transfer function of the analysis filter and/or the synthesis filter may have a delay other than 1.0 so as to warp the spectral envelope.

FIG. 3D illustrates the generic form of the preferred embodiments of the invention by simply representing an adaptive analysis filter 21 having a transfer function "f" that is a function of "h" which is a function of $z^{-1}$, i.e. $f(h(z^{-1}))$, and a synthesis filter 23 having a transfer function "f" which is a function of "j" which is a function of $z^{-1}$, i.e. $f(j(z^{-1}))$. The coefficients in the transfer function "f" in the analysis filter are determined by the adaptive, analysis filter and passed forward to become the coefficents of the transfer function "f" of the synthesis filter. There is no transformation of these coefficients; the coefficients in the analysis filter and the synthesis filter will match. It is the change in the transfer function from $h(z^{-1})$ to $j(z^{-1})$ whereby the warping of the speech signal spectrum is achieved to shift the formants to a different frequency range.

Using the functions in FIG. 3D, the table in FIG. 3E illustrates the various transfer functions for the all-pass filters in the various embodiments of the invention in FIGS. 1, 3A, 3B and 3C. The transfer function $z^{-1}$ is the transfer function of a unit delay element. The other transfer functions in the table are single order transfer functions with a variable "α" cell that may be set to adust the warp of function and the spectral transposition of the envelope of the spectrum. This single order transfer function form of the all-pass filter will be described in more detail hereinafter with reference to FIG. 6. Another all-pass filter transfer function that may be used is $z^{-2}$. Another all-pass filter transfer function that may be used is $z^{-1.x}$ as described earlier with reference to FIG. 3C.

Figure 4:
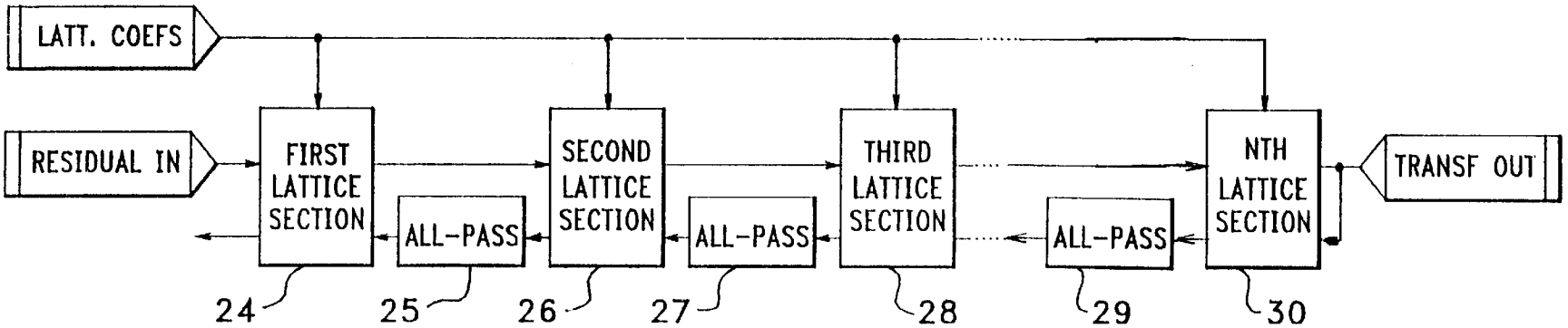
FIG. 4 shows the lattice synthesis filter 12 used in FIG. 1.

In the embodiment of FIG. 1, the synthesis filter 12 is a lattice filter with an all-pass filter in each lattice section. This synthesis filter is shown in FIG. 4. In FIG. 4, each lattice section 24, 26, 28 and 30 receives the corresponding lattice coefficients from the same section in the adaptive lattice filter 10 in FIG. 1. The residual whitened signal is applied as an input at the first lattice section. The residual signal is operated on by that lattice section and passed to the second lattice section 26 and so forth through to the "n" lattice section 30. There is a feedback path in each of the lattice sections. All-pass filter 25 is in the feedback path of section 24. Likewise, all-pass filter 27 and all-pass filter 29 are in the feedback paths of lattice section 26 and lattice section 30, respectively. The details of each lattice section and the inclusion of an all-pass filter in the feedback path from the succeeding section is shown in detail in FIG. 5.

Figure 5:
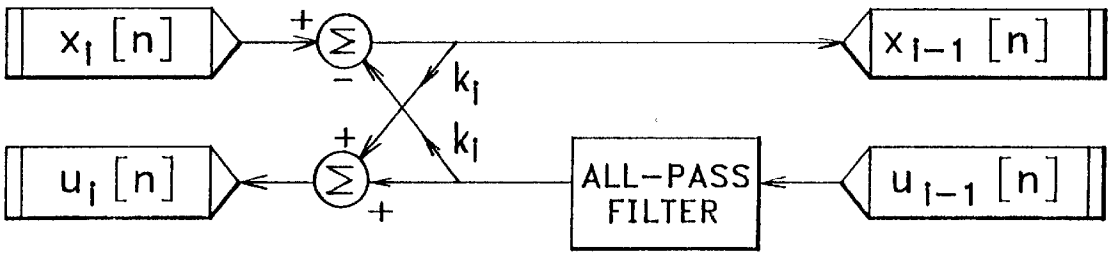
FIG. 5 shows the details of each lattice section with all-pass filter in FIG. 4.

In FIG. 5 each lattice section contains a summer (summing device) in the feed-forward path and the feedback path with coefficients to cross-couple the feed-forward signal to the summer in the feedback path and to cross-couple the all-pass filter signal in the feedback path to the summer in the feed-forward path. The coefficients $k_i$ are the lattice coefficients that come from the adaptive digital lattice filter 10 for the corresponding lattice section in the analysis filter 10. The re-synthesis performed by this structure in FIGS. 4 and 5, is based on IIR (Infinite Impulse Response) lattice filter operation in which the signals between the lattice sections are individual orthognal, i.e. one-dimension in the signal space is added for each section that the signal passes through. Combining this re-synthesis operation with an all-pass feedback in each section, results in a conformal mapping of the unit circle in the "z" plane onto the unit circle of z plane. The z plane is the complex impedance plane for discrete signals.

As a result, the lattice filter depicted in FIGS. 4 and 5 performs a non-linear warping of the spectral envelope of the original signal resynthesized by the lattice coefficients. The frequency range shifting or transposing of the envelope of the frequency spectrum of the re-synthesized signal is controlled by the all-pass filter whose preferred structure is shown in FIG. 6.

While there are a number of possible structures for an all-pass filter, the preferred embodiment produces a filter having a transfer function equal to $(\alpha+Z^{-1})/(1+\alpha Z^{-1})$. In a digital configuration this transfer function is accomplished as shown in FIG. 6 by summer 40 summing the input value from input 42 as multiplied by the preset variable "α" by multiplier 44 with the input signal delayed one unit of sample time by delay register 46. The denominator of the transfer function is produced by feeding back the output signal from node 48 through a unit delay (storage register or latch) 50 with the delayed value multiplied by "α" in multiplier 52 and provided at the negative input to summer 40. Such an all-pass section is a first order all-pass filter. However, the spectral transposition can also be achieved by increasing the order of the all-pass filter.

The amount of actual spectral transposition is determined by the all-pass filter pole position on the impedance plane z and depends on the variable "α" used in multipliers 44 and 52 of FIG. 6. FIG. 7 illustrates frequency transposition curves for various values of "α." If "α" is zero, there is no frequency transposition. If "α" is +0.5 a spectral line at input frequency of 4000 hz is shifted to a spectral line at frequency of approximately 1,500 hz. If "α" is +0.8, the same input spectral line at frequency of 4000 hz is shifted to a spectral line at a frequency of 500 hz. Thus, by controlling "α" in FIG. 6, the frequency transposition of the envelope of the spectrum for input audio signal can be controlled and thus shifted to a point below the point of hearing loss for the individual using the invention.

FIG. 7 also illustrates that for negative "α" the spectral transposition is to higher frequencies rather than to lower frequencies. Thus, if there is a need for a spectral transposition to a higher frequency, the invention handles such a spectral transposition as well.

Figure 8:
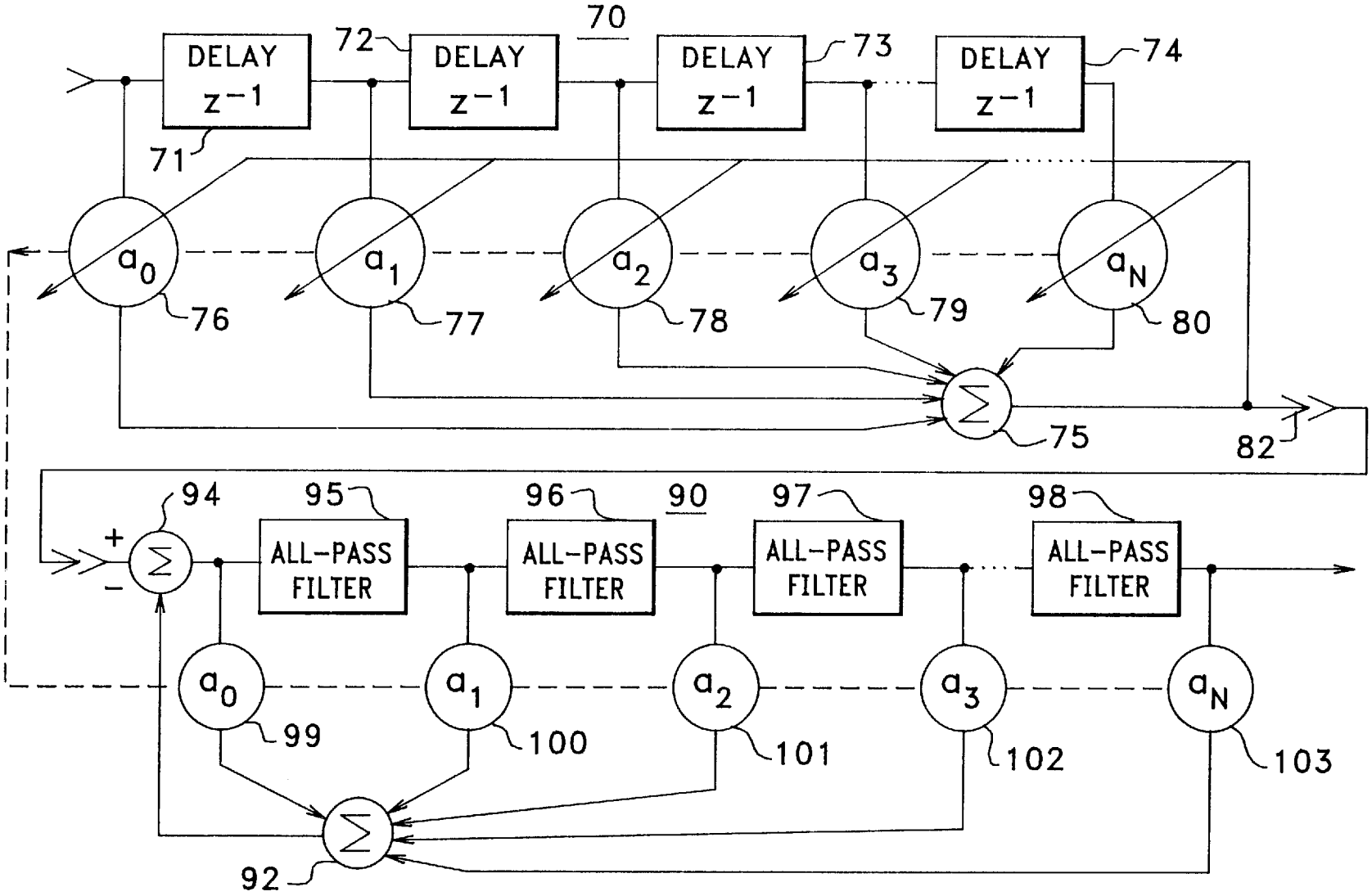
FIG. 8 shows another preferred embodiment of the invention using transversal filter design for the analysis and synthesis filters.

In another alternative embodiment an adaptive, transversal, analysis filter might be used in combination with an all-pole IIR (infinite impulse response) synthesis filter having all-pass filters in place of delay elements. Such an embodiment of the invention is illustrated in FIG. 8. The analysis filter 70 is an adaptive filter. It is composed of successive delay sections 71, 72, 73 and 74 as illustrated in FIG. 8. Each of these sections has its output multiplied by a variable coefficient and then summed by a summing circuit 75. The coefficients $a_0$, $a_1$, $a_2$ through $a_n$ are multiplied by multiplier circuits. The $a_0$ coefficient is multiplied times the input signal by multiplier 76 and the resulting weighted input signal is a part of the sum collected by summing circuit 75. Similarly, each of the outputs of the delay sections 71, 72, 73 and 74 have their outputs weighted by the coefficients $a_1$, $a_2$, $a_3$ through $a_n$ in multiplying circuits 77, 78, 79 and 80 respectively. Feedback from the output of the summing circuit is used to adapt the weighted values for each of the multiplier circuits.

The transfer function of this adaptive, transversal, analysis filter is equal to $a_0+a_1z^1+a_2z^{-2}+a_3z^{-3}+\ldots a_nZ^{-n}$. Once this analysis filter 70 has adapted to the frequency spectrum 14 in FIG. 2, the polynomial transfer function of the filter approximates the polynomial that describes the formants in the frequency spectrum 14 in FIG. 2. The output of the transversal filter at output 82 is whitened residual signal. The coefficients $a_0$ through $a_n$ are the other outputs from the transversal filter. These coefficients are fed to the synthesis filter 90 and used as weighting coefficients in the synthesis filter to reconstruct the digital audio signal analyzed by analysis filter 70.

The synthesis filter 90 has all-pass filters serially connected with a weighting component using the coefficients at each section of the synthesis filter. The weighted output from each all-pass filter in the synthesis filter is collected by a summing circuit 92 and provided as negative feedback to summing circuit 94 at the input of the synthesis filter. The residual whitened signal is applied at summing circuit 94 and the other input to summing circuit 94 is the negative feedback of the weighted output from each all-pass filter sections.

All-pass filters 95, 96, 97, and 98 have their outputs weighted by multiplying circuits 100, 101, 102, and 103. In addition, the input to the first all-pass filter is weighted by multiplying circuit 99. The weight coefficients for each of these multiplying circuits 99 through 103 are the same coefficients as determined by the adaptive analysis filter 70. By replacing the delay sections in the synthesis filter with all-pass filter sections, the "$\alpha$" variable in the all-pass filter as described earlier for FIG. 6, may be adjusted to warp the synthesis operation and thereby transpose to a new frequency range the frequency spectrum being re-synthesized by the synthesis filter 90. Thus, the analysis filter 70 and the synthesis filter 90 in FIG. 8, maybe substituted for the adaptive digital lattice filter 10 and the lattice synthesis filter 12 in FIG. 1. The preferred implementation is the FIG. 1 implementation as the frequency transposed in re-synthesized audio signal is of higher quality in the embodiment of FIG. 1.

Figure 9:
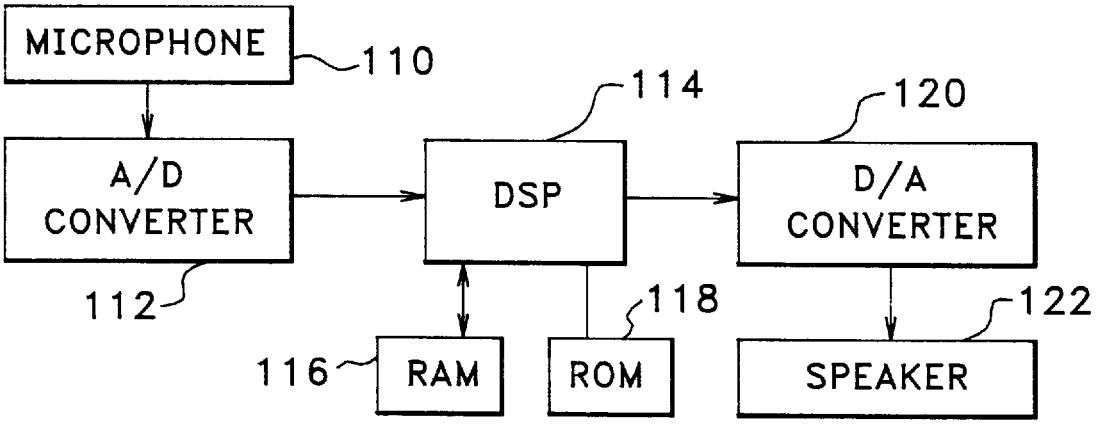
FIG. 9 shows another preferred embodiment of the invention using a programmed digital signal processor for performing the audio signal processing operations described in the other embodiments of the invention.

Yet another embodiment of the invention is shown in FIG. 9. Instead of using hardwired structures for the adaptive and re-synthesis filters as depicted in FIG. 1 and FIG. 8, the same operations can be performed by a programmed digital signal processor. Thus, in the embodiment in FIG. 9, the microphone 110 picks up the voice audio signal. The analog-to-digital converter 112 converts that audio signal to a digital signal and passes the digital signal to the digital signal processor 114.

Digital signal processor 114 has working storage in RAM 116 and program storage in ROM 118. The program in ROM 118 would perform the operations described earlier for the adaptive analysis filter and the synthesis filters in the various embodiments shown and described in FIGS. 1, 3A–3D, 4 and 8, and the all-pass filter in FIG. 6. Working storage 116 would store the digital values in the delay sections depicted in those figures. Once the spectral transposition has been processed by the DSP 114, the frequency shifted spectrum is passed to digital-to-analog converter 120. The D/A converter 120 converts the audio digital signal represented by spectrum 16 back to an analog signal. The analog signal is passed to amplifier and speaker 122 to be reproduced as speech information shifted to the frequency range of the hearing impaired user.

While the invention has been particularly shown and described with reference to preferred embodiments thereof, it will be understood by those skilled in the art that various other changes in the form and details may be made therein without departing from the spirit and scope of the invention.

I claim:

1. Apparatus for transposing to a new frequency range formants of a digital audio signal, said apparatus comprising:

an adaptive analysis filter analyzing the digital audio signal and producing a whitened residual signal and formant coefficients of a polynomial expression indicative of the formants in a frequency spectrum of the digital audio signal;

a synthesis filter, responsive to the whitened residual signal and the formant coefficients, for generating resynthesized the digital audio signal;

said analysis filter and said synthesis filter having different group delay characteristics in order to warp the spectral envelope of the resynthesized digital audio signal from said synthesis filter whereby the formants of the digital audio signal are transposed to the new frequency range.

2. The apparatus of claim 1 wherein:

the group delay characteristic of said analysis filter is a function of a unit delay, $z^{-1}$; and the group delay characteristic of said synthesis filter is a function of a fractional unit delay, $z^{-1.x}$.

3. The apparatus of claim 2 wherein the group delay characteristic of said synthesis filter is provided by an all-pass filter having a transfer function with a variable fractional unit delay over the spectrum of the digital audio signal.

4. The apparatus of claim 1 wherein:

the group delay characteristic of said synthesis filter is a function of a unit delay, $z^{-1}$; and the group delay characteristic of said analysis filter is a function of a fractional unit delay, $z^{-1.x}$.

5. The apparatus of claim 1 wherein:

the group delay characteristic of both said analysis filter and said synthesis filter is a function of a fractional unit delay, $z^{-1.x}$.

6. Apparatus for aiding a hearing impaired person to hear audio signals normally outside the frequency range of the person's hearing capability, said apparatus comprising:

a microphone detecting audio input and producing an analog audio signal;

an analog-to-digital converter converting the analog audio signal into a digital audio signal;

an adaptive analysis filter analyzing the digital audio signal and producing a whitened residual signal and formant coefficients of a polynomial expression indicative of the formants in a frequency spectrum of the digital audio signal;

a synthesis filter, responsive to the whitened residual signal and the formant coefficients, synthesizing the digital audio signal to provide a resynthesized digital audio signal;

said analysis filter and said synthesis filter having different group delay characteristics in order to warp the spectral envelope of the resynthesized digital audio signal whereby the formants of the digital audio signal are transposed to a new frequency range within the person's hearing capability.

7. The apparatus of claim 6 wherein:

the group delay characteristic of said analysis filter is a function of a unit delay, $z^{-1}$; and the group delay characteristic of said synthesis filter is a function of a fractional unit delay, $z^{-1.x}$.

8. The apparatus of claim 7 wherein the group delay characteristic of said synthesis filter is provided by an all-pass filter having a transfer function with a variable fractional unit delay over the spectrum of the audio digital signal.

9. The apparatus of claim 6 wherein:

the group delay characteristic of said synthesis filter is a function of a unit delay, $z^{-1}$; and the group delay characteristic of said analysis filter is a function of a fractional unit delay, $z^{-1.x}$.

10. The apparatus of claim 6 wherein:

the group delay characteristic of both said analysis filter and said synthesis filter is a function of a fractional unit delay, $z^{-1.x}$.

11. The apparatus of claim 6 and in addition:

a digital-to-analog converter for converting the resynthesized digital audio signal into a new analog audio signal transposed to the new frequency range; and a speaker for producing audio output from the new analog audio signal.

12. Apparatus for aiding a hearing impaired person to hear audio signals normally outside the frequency range of the person's hearing capability, said apparatus comprising:

a microphone detecting audio input and producing an analog audio signal;

an analog-to-digital converter converting the analog audio signal into a digital audio signal;

an adaptive lattice analysis filter analyzing the digital audio signal and producing a whitened residual signal and lattice coefficients indicative of the formants in a frequency spectrum of the digital audio signal;

first all-pass filters connected between lattice sections of said analysis filter having a first group delay characteristic;

a lattice synthesis filter, responsive to the whitened residual signal and the lattice coefficients, for generating a resynthesized digital audio signal;

second all-pass filters connected between lattice sections of said synthesis filter having a second group delay characteristic;

said first group delay characteristic being different from said second group delay characteristic in order to warp the spectral envelope of the resynthesized digital audio signal whereby the formants of the digital audio signal are transposed to a new frequency range;

a digital-to-analog converter for converting the resynthesized digital audio signal into a new analog audio signal transposed to the new frequency range; and a speaker for producing audio output from the new analog audio signal.

13. The apparatus of claim 12 wherein:

each of said first all-pass filters has a transfer function of the form $Z^{-1}$;

each of said second all-pass filters has a transfer function of the form $(a+Z^{-1})/(1+aZ^{-1})$ where a is a preset variable between 0.0 and 1.0.

14. The apparatus of claim 12 wherein:

each of said first all-pass filters has a transfer function of the form $(a_1+Z^{-1})/(1+a_1Z^{-1})$ where $a_1$ is a preset variable between 0.0 and 1.0; and each of said second all-pass filters has a transfer function of the form $(a_2+Z^{-1})/(1+a_2Z^{-1})$ where $a_2$ is a preset variable between 0.0 and 1.0 and is different from preset variable $a_1$.

15. The apparatus of claim 12 wherein:

each of said first all-pass filters has a transfer function of the form $(a+Z^{-1})/(1+aZ^{-1})$ where a is a preset variable between 0.0 and 1.0; and each of said second all-pass filters has a transfer function of the form $Z^{-1}$.

* * * * *